US010916130B2

(12) United States Patent
Zhu

(10) Patent No.: US 10,916,130 B2
(45) Date of Patent: Feb. 9, 2021

(54) DYNAMIC RIGHT OF WAY TRAFFIC SYSTEM

(71) Applicant: Baidu USA LLC, Sunnyvale, CA (US)

(72) Inventor: Fan Zhu, Sunnyvale, CA (US)

(73) Assignee: BAIDU USA LLC, Sunnyvale, CA (US)

( * ) Notice: Subject to any disclaimer, the term of this patent is extended or adjusted under 35 U.S.C. 154(b) by 119 days.

(21) Appl. No.: 16/364,160

(22) Filed: Mar. 25, 2019

(65) Prior Publication Data

US 2020/0312131 A1 Oct. 1, 2020

(51) Int. Cl.
*G08G 1/07* (2006.01)
*G08G 1/01* (2006.01)

(52) U.S. Cl.
CPC ..... *G08G 1/07* (2013.01); *G08G 1/0116* (2013.01); *G08G 1/0145* (2013.01)

(58) Field of Classification Search
CPC ..... G08G 1/07; G08G 1/081; G08G 1/0116; G08G 1/0145; G08G 1/00; G08G 1/086716; G08G 1/164; G08G 1/08; G08G 1/162
USPC ..... 340/918, 919
See application file for complete search history.

(56) References Cited

U.S. PATENT DOCUMENTS

| | | | | |
|---|---|---|---|---|
| 8,847,788 | B2 * | 9/2014 | Borland | G08G 1/096741 340/906 |
| 9,805,595 | B1 * | 10/2017 | Liebinger Portela | G08G 1/0112 |
| 9,953,526 | B2 * | 4/2018 | Arnold | G08G 1/07 |
| 9,965,951 | B1 * | 5/2018 | Gallagher | G08G 1/0133 |
| 10,276,043 | B2 * | 4/2019 | Vijaya Kumar | G06K 9/00805 |
| 10,403,142 | B1 * | 9/2019 | Shuff | G08G 1/07 |
| 10,692,367 | B2 * | 6/2020 | Nguyen | G08G 1/08 |
| 2002/0073586 | A1 * | 6/2002 | Backe | G09F 15/0087 40/612 |
| 2009/0184843 | A1 * | 7/2009 | Shaffer | G08G 1/096716 340/933 |
| 2017/0103650 | A1 * | 4/2017 | Amadon | G08G 1/095 |
| 2018/0190111 | A1 * | 7/2018 | Green | G08G 1/0145 |

* cited by examiner

*Primary Examiner* — Eric Blount
(74) *Attorney, Agent, or Firm* — Womble Bond Dickinson (US) LLP

(57) ABSTRACT

In one embodiment, a system displays a priority sign for a first road and a yield sign for a second road as a default right of way for a road intersection. The system receives signals from one or more X2X sensors detecting a traffic flow for a predetermined segment of road for each of the first and the second roads before the road intersection. If it is determined the traffic flow of the first road has no vehicle and the traffic flow of the second road includes at least one vehicle, the system initiates a first timer to count a predetermined time duration. If the traffic flow of the first road is determined to remain with no vehicle for the predetermined time duration, the system reverses the default right of way for the intersection so traffic signs for the first road displays yield and the second road displays priority.

21 Claims, 9 Drawing Sheets

300

DYNAMIC RIGHT OF WAY TRAFFIC SYSTEM

TECHNICAL FIELD

Embodiments of the present disclosure relate generally to operating autonomous vehicles. More particularly, embodiments of the disclosure relate to a dynamic right of way traffic system.

BACKGROUND

For road transport, a yield right of way traffic sign indicates that each driver must prepare to stop if necessary to let a driver on another roadway to proceed. For example, when two drivers arrive at a cross road simultaneously, a driver with a yield sign would yield the right of way to the other driver to go first. Typically the yield sign is place at a subordinate roadway of a cross road having less traffic to yield to vehicles of a dominant roadway that has priority. For some regions, displaying a yield sign for a roadway of an intersection with two roadways usually mean the other roadway of the intersection (without a traffic sign) has priority, while for some regions, a specific priority sign is used in conjunction with a yield sign.

Right of way traffic signs allow for an efficient traffic flow for traffic intersections when the dominant roadway has a higher traffic volume. However, right of way traffic signs are not efficiency when the traffic volume is reversed, e.g., the subordinate roadway has the higher traffic volume.

BRIEF DESCRIPTION OF THE DRAWINGS

Embodiments of the disclosure are illustrated by way of example and not limitation in the figures of the accompanying drawings in which like references indicate similar elements.

DETAILED DESCRIPTION

Various embodiments and aspects of the disclosures will be described with reference to details discussed below, and the accompanying drawings will illustrate the various embodiments. The following description and drawings are illustrative of the disclosure and are not to be construed as limiting the disclosure. Numerous specific details are described to provide a thorough understanding of various embodiments of the present disclosure. However, in certain instances, well-known or conventional details are not described in order to provide a concise discussion of embodiments of the present disclosures.

Reference in the specification to "one embodiment" or "an embodiment" means that a particular feature, structure, or characteristic described in conjunction with the embodiment can be included in at least one embodiment of the disclosure. The appearances of the phrase "in one embodiment" in various places in the specification do not necessarily all refer to the same embodiment.

According to one embodiment, a system or method is disclosed to display right of way traffic signs for an efficient traffic flow. The system displays a priority sign for a first road and a yield sign for a second road as a default right of way for a road intersection. The system receives signals from one or more everything-to-everything (X2X) sensors detecting a traffic flow for a predetermined segment of road for each of the first and the second roads before the road intersection. If it is determined the traffic flow of the first road has no vehicle and the traffic flow of the second road includes at least one vehicle, the system initiates a first timer to count a predetermined time duration. If the traffic flow of the first road is determined to remain with no vehicle for the predetermined time duration, the system reverses the default right of way for the intersection so traffic signs for the first road reads yield and the second road reads priority.

Figure 1:
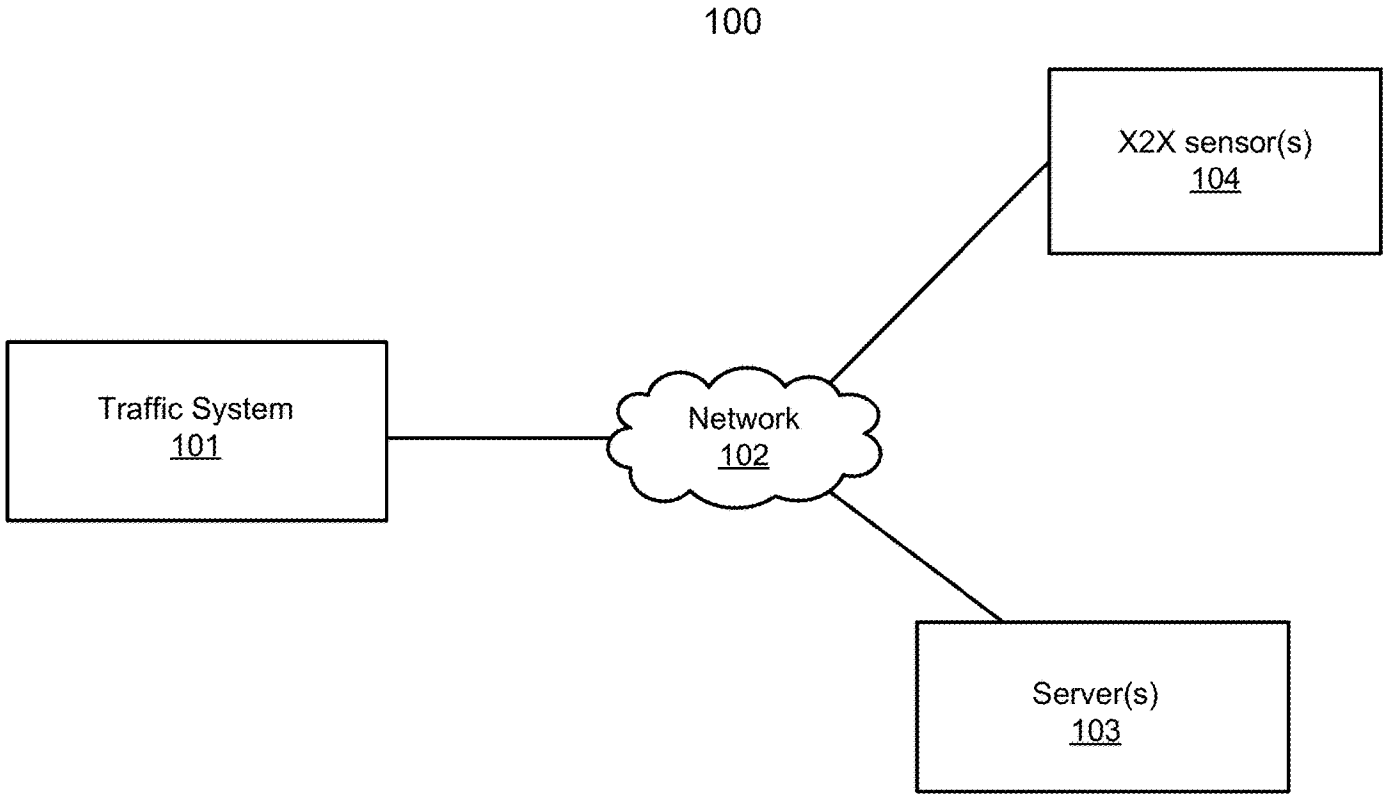
FIG. 1 is a block diagram illustrating a networked system according to one embodiment.

FIG. 1 is a block diagram illustrating a networked system according to one embodiment of the disclosure. Referring to FIG. 1, network configuration 100 includes traffic system 101 that may be communicatively coupled to one or more servers 103 and X2X sensors 104 over a network 102. Although there is one traffic system shown, multiple traffic systems can be coupled to each other and/or coupled to servers 103 and X2X sensors 104 over network 102. Network 102 may be any type of networks such as a local area network (LAN), a wide area network (WAN) such as the Internet, a cellular network, a satellite network, or a combination thereof, wired or wireless. Server(s) 103 may be any kind of servers or a cluster of servers, such as Web or cloud servers, application servers, backend servers, or a combination thereof. Servers 103 may be data analytics servers, content servers, traffic information servers, traffic controller servers, traffic services servers, etc. X2X sensors 104 may include a network of one or more X2X sensors sharing sensor data information of one or more traffic intersections. Examples of X2X sensors can include camera sensors, radar sensors, light detection sensors, and/or any type of sensors that can detect a presence of a vehicle to determine a traffic flow for a roadway. The sensors may be installed before road junctions or intersection points and the sensors can capture sensor data information to be delivered to the traffic system.

Figure 2:
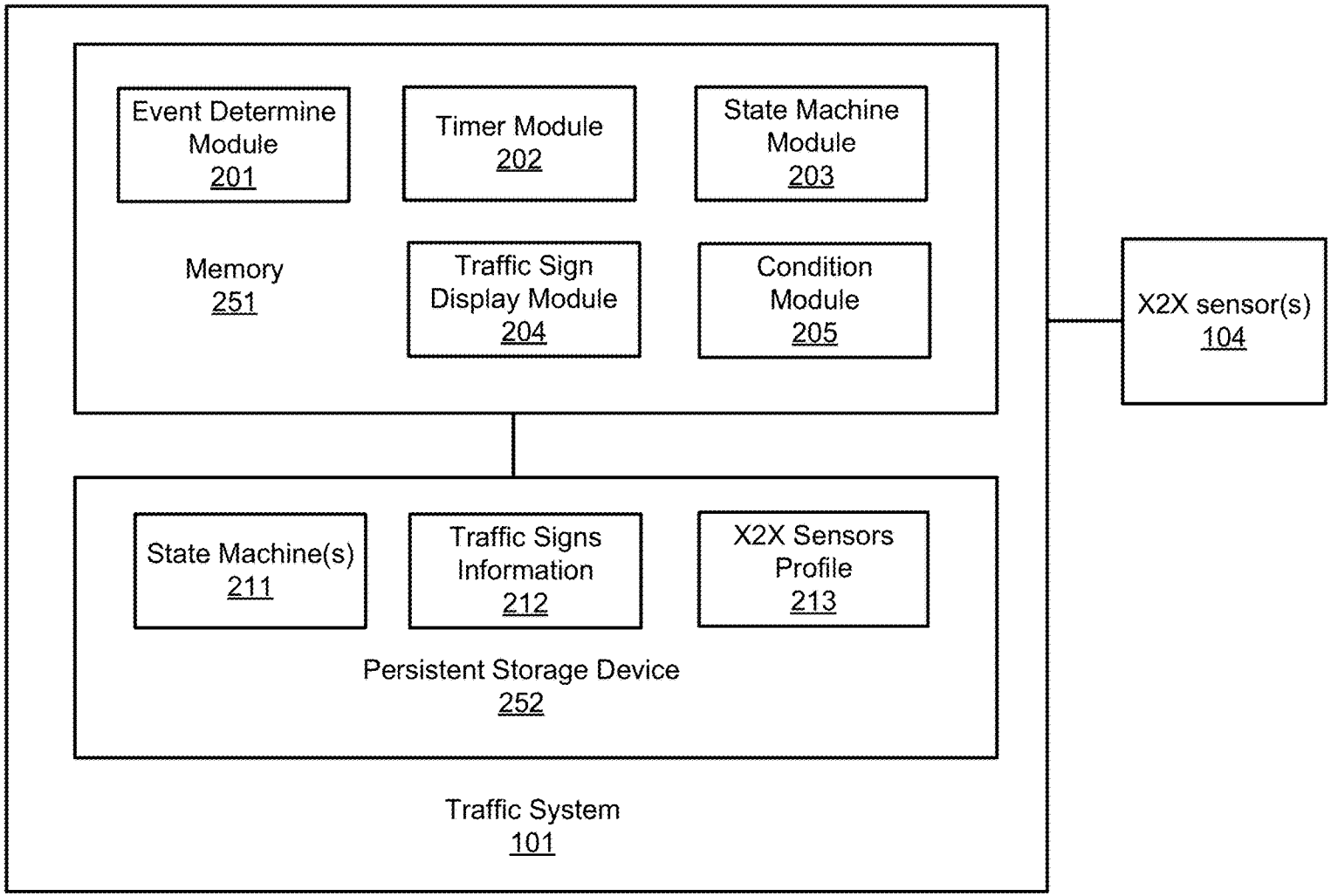
FIG. 2 is a block diagram illustrating an example of a traffic system according to one embodiment.

FIG. 2 is a block diagram illustrating an example of a traffic system according to one embodiment. A traffic system refers to a system that can be configured to display different traffic signs on a display to control one or more traffic flow for one or more traffic intersections. Referring to FIG. 2, traffic system 101 can include event determine module 201, timer module 202, state machine module 203, traffic sign display module 204, and condition module 205.

Some or all of modules 201-205 may be implemented in software, hardware, or a combination thereof. For example, these modules may be installed in persistent storage device 252, loaded into memory 251, and executed by one or more processors (not shown). Note that some or all of modules 201-205 may be integrated together as an integrated module.

Referring to FIG. 2, event determine module 201 can determine an event has occurred. Examples of some events can include a first road includes at least a vehicle, the first road includes no vehicle, a second road includes at least one vehicle, the second road includes no vehicle, or a combination thereof, where the first and the second roads meet at an intersection. Timer module 202 can set a timer to count a predetermined time duration since an event has occurred. The timer module can be configured to trigger state machine module 203 to update a current state after the time duration has passed (e.g., the timer expires or lapses). State machine module 203 can update a current state or a next state for state machine(s) 211, based on a previous state. Note, state machine(s) 211 can use information from one or more X2X sensor profiles 213 to retrieve sensor data from one or more X2X sensors (as part of X2X sensors 104) to determine a state for the state machine(s) 211 to display right of way traffic signs for traffic system 101. In one embodiment, X2X sensors profile 213 may be part of X2X sensors 104. In another embodiment, X2X sensors profile 213 may include information about X2X sensors, e.g., location of the X2X sensors, frequency of data feed.

Traffic sign display module 204 can display traffic signs, such as electronic right of way signs, on a display using traffic signs information 212. For example, traffic signs information 212 can include graphical representations of various traffic signs that may be displayed. Traffic signs information 212 can also include different language and/or region codes associated with the traffic signs, so information for different graphical representations of the traffic signs can be stored for different languages and/or regions. In another example, traffic signs information 212 can include information for the number of displays (e.g., traffic sign displays) installed and the locations of the installations, where the displays are used to display digital traffic signs. Traffic signs information 212 can further include information about the different types of traffic signs, including but not limited to, stop signs, traffic lights (red, yellow, green), right of way signs, speed limit signs, pedestrian crossing signs, etc. Traffic signs information 212 can further include information for that right of way traffic signs that are paired, where a pair of right of way traffic signs is configured as binary signs. Binary signs refer to two signs where, e.g., if a first sign displays a yield right of way, a second sign displays a priority right of way, and vice versa.

Condition module 205 can further limit a state change for state machine(s) 211 upon satisfaction of a predetermined condition. For example, condition module 205 can condition a state machine module to trigger a state transition conditional on happening of an event, or absence of an event. Note, traffic system 101 may be a standalone unit or integrated (e.g., housed) with any of the digital traffic sign displays and/or X2X sensors.

Figure 3:
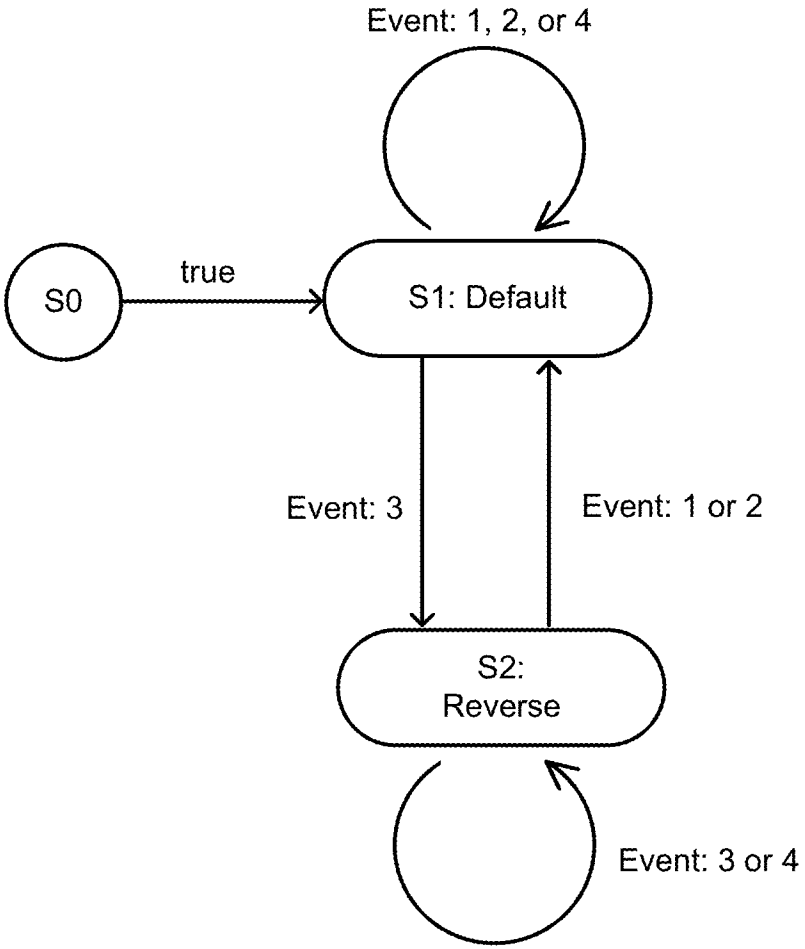
FIG. 3 is a block diagram illustrating an example of a state machine according to one embodiment.

FIG. 3 is a block diagram illustrating an example of a state machine according to one embodiment. Referring to FIG. 3, state machine 300 can be a state machine for a right of way traffic system (as part of state machine(s) 211 of FIG. 2). In one embodiment, state machine 300 can include three states: S0 initial, S1 default, and S2 reverse states. In this case, state machine 300 initializes to S0, and S0 transitions to S1. If a certain event follows, as determined by event determine module 201) and/or a condition is satisfied (by condition module 205), S1 can transition to S2. The default state S1 can refer to a priority for a first road (e.g., road A) and a yield for a second road (e.g., road B), where the first and the second roads are two roads of a road intersection for the right of way traffic system. The S2 reverse state can then refer to a reverse of the default state, e.g., a yield for the first road (road A) and a priority for the second road (road B). The road intersection may be, but is not limited to, a fork, a T intersection, a cross intersection, etc.

In one embodiment, a list of events includes:

Event 1: a traffic flow of both road A and road B has no vehicles. Under this event (as determined by event determine module 201 of FIG. 2), a current state is to transition to a next state S1, regardless of the current state for a state machine. In one embodiment, the transition is further conditioned on a predetermined time duration has passed where road B has no vehicles, as determined by a condition module (such as condition module 205 of FIG. 2). Here, a timer can be initiated by a timer module (such as module 202 of FIG. 2) to count a predetermined time duration to satisfy such a condition. In another embodiment, for event 1, a current state is to transition to a next state that is the same as the current state for the state machine.

Event 2: a traffic flow of road A has at least one vehicle and road B has no vehicle. Under this event, a current state is to transition to a next state S1 regardless of the current state. In one embodiment, the transition is further conditioned on a predetermined time duration has passed where road A has at least one vehicle. Here, the traffic system can initiate a timer to count the predetermined time duration to satisfy such a condition.

Event 3: a traffic flow of road A has no vehicle and road B has at least one vehicle. For this event, for a first scenario, if a current state is S1 default state, the current state is to transition to S2 reverse state. In one embodiment, the transition is further conditioned on a predetermined time duration has passed where road A has no vehicles. Here, the traffic system can initiate a timer to count the predetermined time duration to satisfy such a condition. For a second scenario, if a current state is S2 reverse state, the current state is to transition to S2 reverse state.

Event 4: a traffic flow of roads A and B both include vehicles. For this event, for the first scenario, if a current state is S1 default state, the current state is to transition to S1 default state. For a second scenario, if a current state is S2 reverse state, the current state is to transition to S2 reverse state.

Referring to FIG. 3, in one embodiment, S1 transitions to S2 if event 3 has occurred. S2 transitions to S1 if event 1 or 2 has occurred. S1 transitions to S1 if event 1, 2, or 4 has occurred. S2 transitions to S2 if event 3 or 4 has occurred. Note here, the disclosed traffic system 101 allows for a greater number of vehicles to avoid unnecessary deceleration caused by a static yield sign, e.g., when there is an absence of traffic on the main roadway, the vehicles for the subordinate roadway would have a priority sign. In addition, the right of way traffic system avoids unnecessary hesitations caused by an absence of traffic signs altogether because the right of way traffic signs can help drivers decide whether to yield a right of way.

Figure 4:
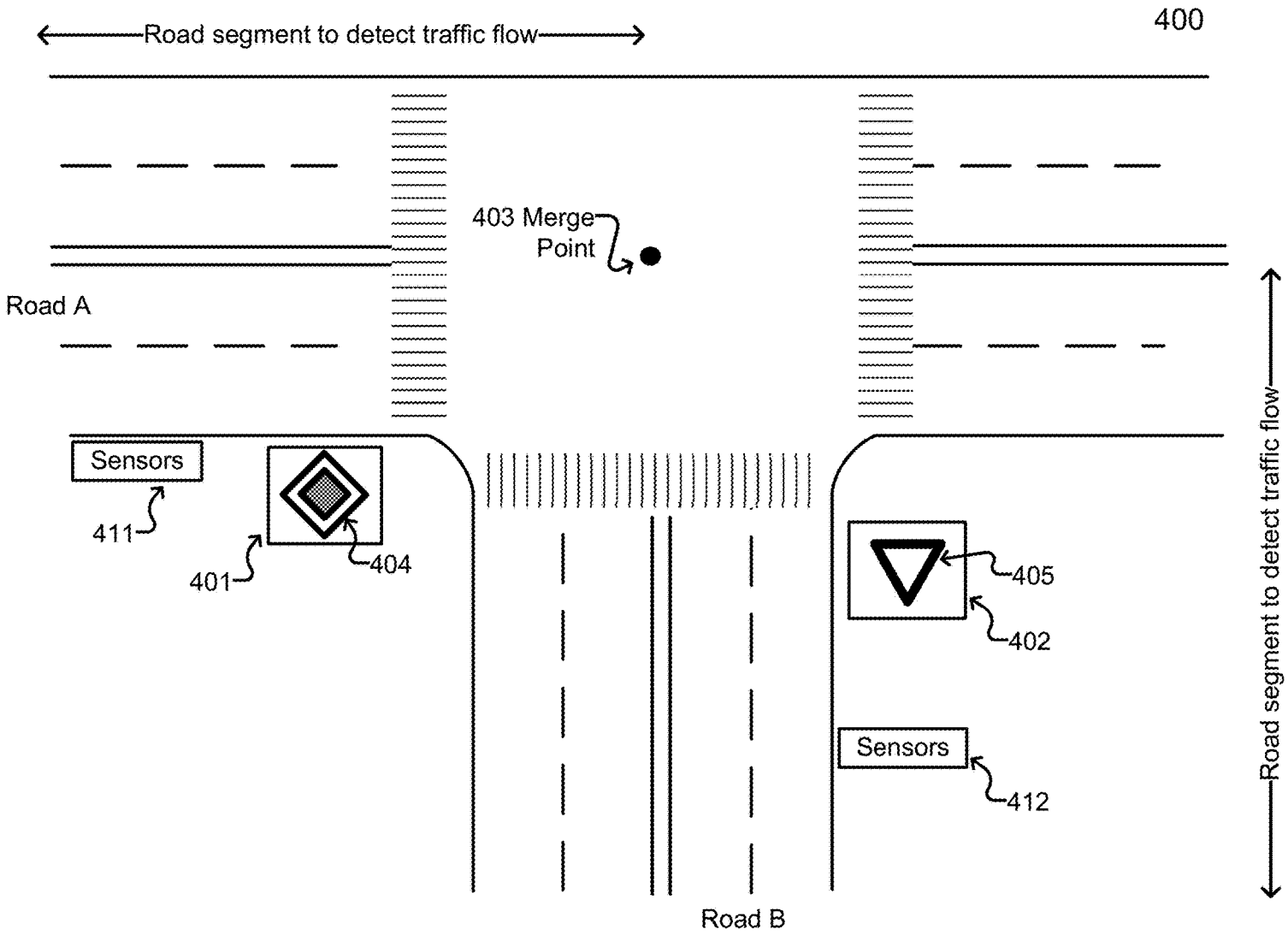
FIG. 4 is a block diagram illustrating an example road intersection according to one embodiment.

FIG. 4 is a block diagram illustrating an example road intersection according to one embodiment. Referring to FIG. 4, for scenario 400, the road intersection is a T intersection which includes road A (e.g., a first road) and road B (e.g., a second road), traffic sign displays 401-402, and X2X sensors 411-412. Note, traffic system 101 can be embedded in any one of traffic sign displays 401-402 or X2X sensors 411-412 or traffic system 101 can be a standalone unit. The road intersection also includes a merge point 403. Merge point 403 refers to a point of intersection where two roads (A and B) merge. Here, a default state or default traffic flow can be set to be a priority right of way for road A and a yield right of way for road B.

Referring to FIG. 4, in one embodiment, a predetermined segment of road for road A and road B (e.g., 16 seconds stretch of road before merge point 403) can be used by sensors 411 and 412 to detect whether there is incoming vehicular traffic for the respective road segments. Presence of incoming vehicle traffic would include at least one vehicle, while absence of incoming vehicular traffic has no vehicle, for the respective segments of road. In this case, sensor(s) 411 detects no vehicle for road A and sensor(s) 412 detects no vehicle for road B. The traffic system then determines the traffic flow of the intersection to be categorized as event 1 based on sensors information from sensor(s) 411-412.

In one embodiment, for event 1, where both roads A and B have no vehicle, a current state of a state machine for traffic system 101 dynamically transitions to a next state of S1 default state, regardless of the current state. For the S1 default state, display 401 displays a priority sign 404 (e.g., an electronic digital traffic sign) and display 402 displays a yield sign 405 (e.g., an electronic digital traffic sign). In one embodiment, under event 1, timer is set to count a predetermined time duration and the transition is conditional by an absence of vehicles for road B for the predetermined time duration. In another embodiment, for event 1, where both roads A and B have no vehicle, a current state of a state machine for traffic system 101 dynamically transitions to a next state which is equal to the current state.

Figure 5:
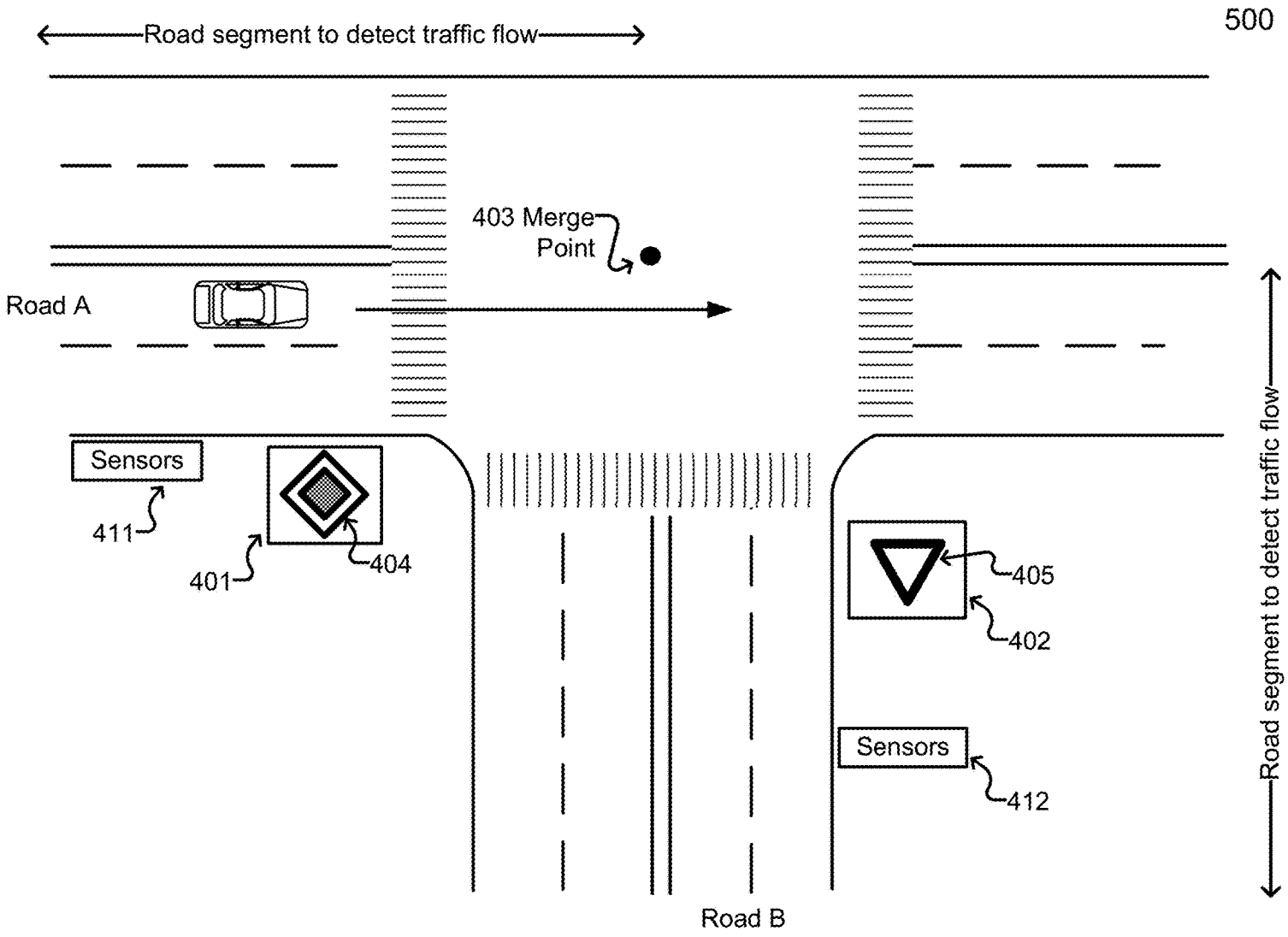
FIG. 5 is a block diagram illustrating an example road intersection according to one embodiment.

Referring to FIG. 5, in one embodiment, for scenario 500, sensor(s) 411 detects at least one vehicle for road A and sensor(s) 412 detects no vehicle for road B. The traffic system then determines the traffic flow of the intersection to be categorized as event 2 based on sensors information from sensor(s) 411-412.

In one embodiment, for event 2, where a traffic flow of road A has at least one vehicle and road B have no vehicle, a current state of a state machine for traffic system 101 dynamically transitions to a next state of S1 default state, regardless of the current state. For the S1 default state, display 401 displays a priority sign 404 and display 402 displays a yield sign 405.

Figure 6:
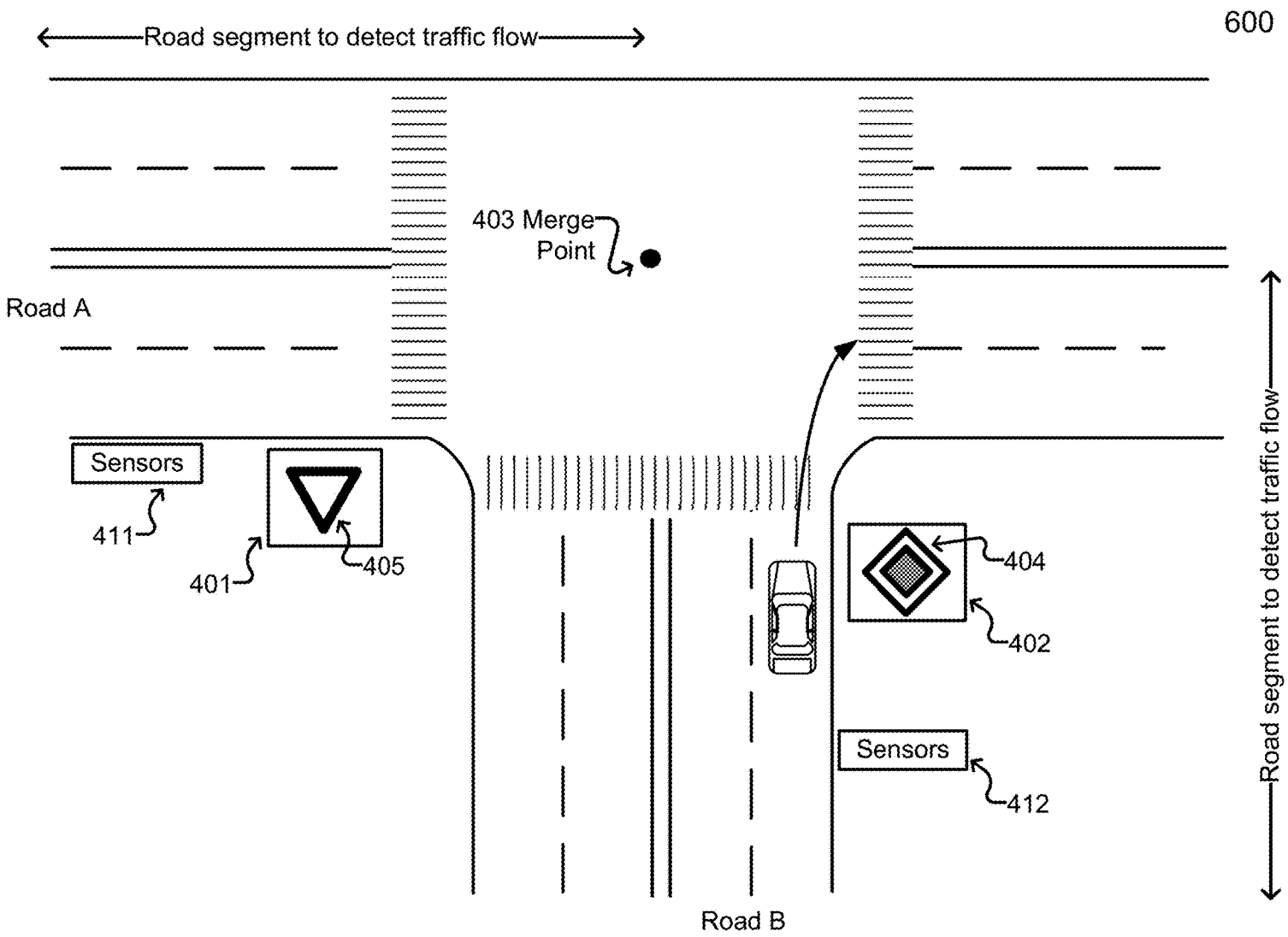
FIG. 6 is a block diagram illustrating an example road intersection according to one embodiment.

Referring to FIG. 6, in one embodiment, for scenario 600, sensor(s) 411 detects no vehicle for road A and sensor(s) 412 detects at least one vehicle for road B. The traffic system then determines the traffic flow of the intersection to be categorized as event 3 based on sensors information from sensor(s) 411-412.

In one embodiment, for event 3, where a traffic flow of road A has no vehicle and road B has at least one vehicle, a current state of a state machine for traffic system 101 dynamically transitions to a next state of S2 reverse state, if a current state is S1 provided that there is no traffic flow for road A for a predetermined time duration. If a current state is S2, then the state machine dynamically transitions to a next state of S2 reverse state. For the S2 reverse state, display 401 displays a yield sign 405 and display 402 displays a priority sign 404.

Figure 7:
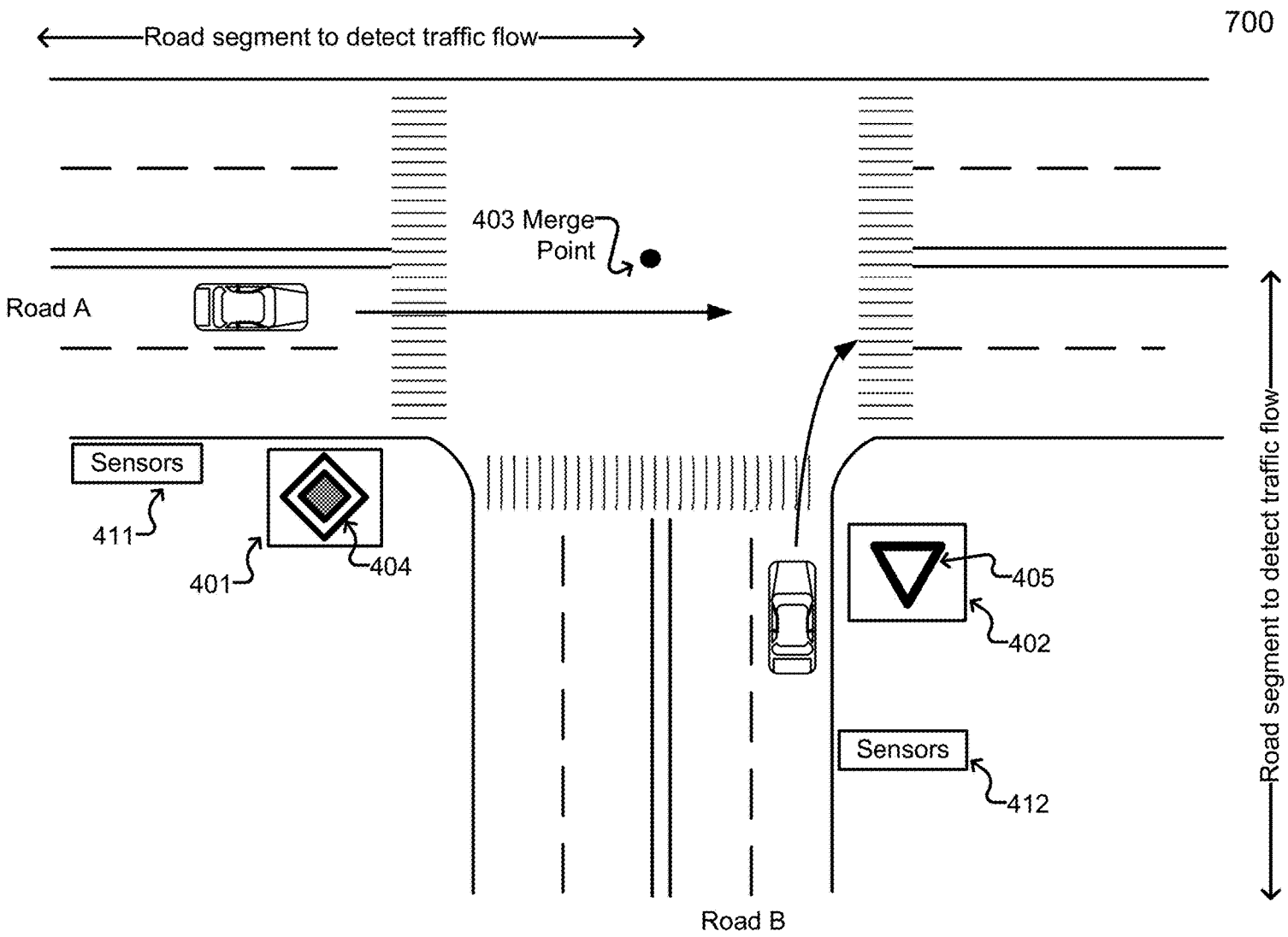
FIG. 7 is a block diagram illustrating an example road intersection according to one embodiment.

Referring to FIG. 7, in one embodiment, for scenario 700, sensor(s) 411 detects at least one vehicle for road A and sensor(s) 412 also detects at least one vehicle for road B. The traffic system then determines the traffic flow of the intersection to be categorized as event 4 based on sensors information from sensor(s) 411-412.

In one embodiment, for event 4, where a traffic flow of both roads A and B have at least one vehicle, a current state for a state machine for traffic system 101 dynamically transitions to a next state to be the current state. For example, if a current state is S1, the next state is S1. If a current state is S2 then the next state is S2. Referring to FIG. 7, a current state S1 dynamically transitions to a next state of S1. For the S1 default state, display 401 displays a priority sign 404 and display 402 displays a yield sign 405.

Figure 8:
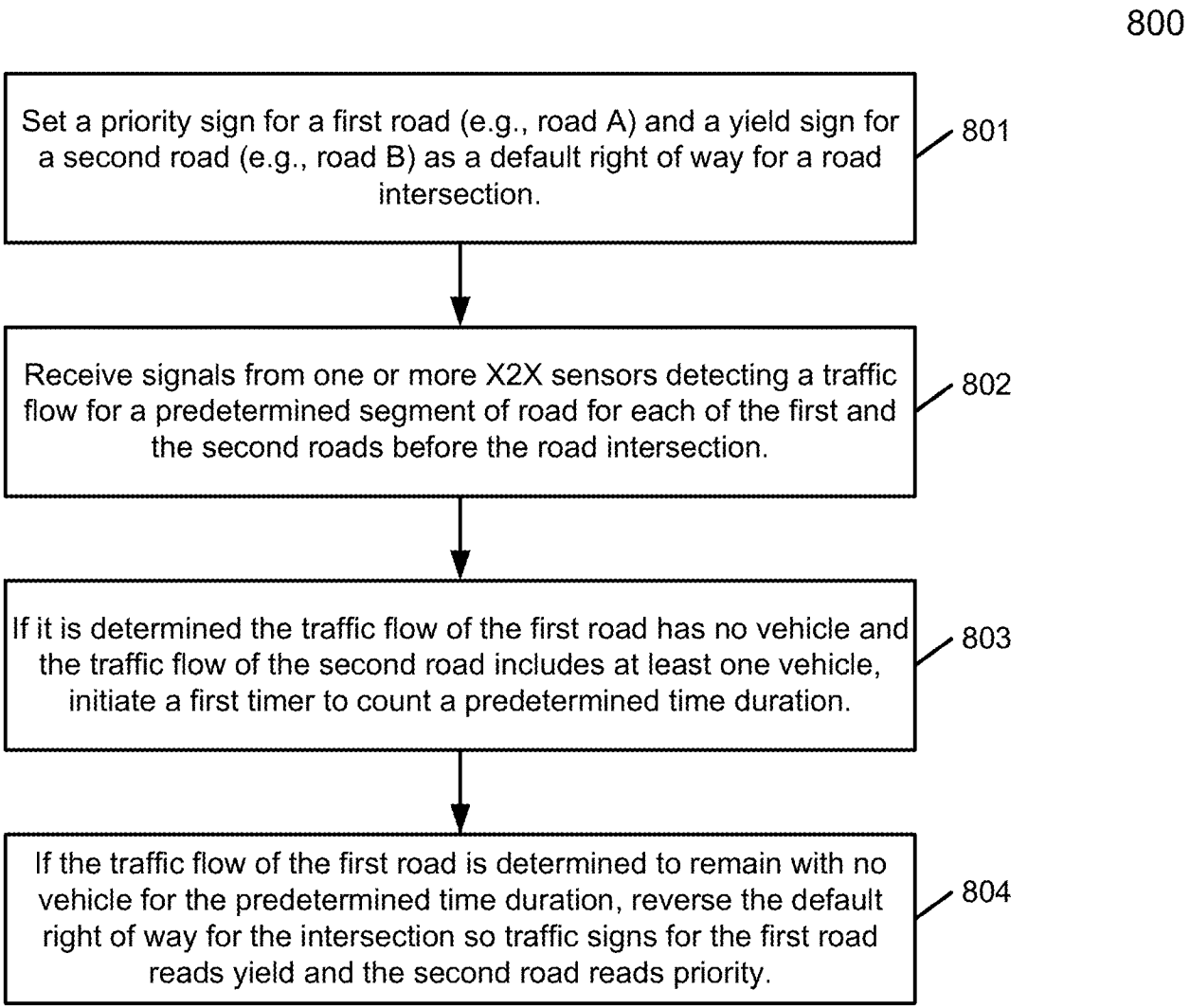
FIG. 8 illustrates an example flow diagram for a method according to one embodiment.

FIG. 8 illustrates an example flow diagram for a method according to one embodiment. Process 800 may be performed by processing logic which may include software, hardware, or a combination thereof. For example, process 800 may be performed by traffic system 101 of FIG. 2. Referring to FIG. 8, at block 801, processing logic displays a priority sign for a first road and a yield sign for a second road as a default right of way for a road intersection. At block 802, processing logic receives signals from one or more X2X sensors detecting a traffic flow for a predetermined segment of road for each of the first and the second roads before the road intersection. At block 803, if it is determined the traffic flow of the first road has no vehicle and the traffic flow of the second road includes at least one vehicle, processing logic initiates a first timer to count a predetermined time duration. At block 804, if the traffic flow of the first road is determined to remain with no vehicle for the predetermined time duration, processing logic reverses the default right of way for the intersection so traffic signs for the first road displays yield and the second road displays priority.

In one embodiment, the traffic signs for the first and the second roads are binary traffic signs such that if the traffic sign for the first road is to display a yield sign, the second road is automatically updated to display a priority sign, and if the first road is to display a priority sign, the second road is automatically updated to display a yield sign. In one embodiment, the traffic signs for the first and the second roads are displayed using electronic digital traffic signs.

In one embodiment, processing logic further determines a state for the traffic signs using a state machine, where the state machine includes at least two states: a default state and a reverse state. In one embodiment, if the traffic flows for both the first and the second roads are determined to have no vehicles, processing logic further initiates a second timer to count a predetermined time duration. If the traffic flows of both the first and the second roads are determined to remain with no vehicle for the predetermined time duration of the second timer, processing logic further displays the default right of way for the traffic signs.

In one embodiment, if the traffic flows for both the first and the second roads are each determined to include at least one vehicle and the traffic signs include the default right of way, processing logic further keeps the traffic signs as the default right of way, or if the traffic flows for both the first and the second roads are each determined to include at least one vehicle and the traffic signs include a reversed right of way, processing logic further keeps the traffic signs reversed.

In one embodiment, if the traffic flow for the first road includes at least one vehicle and the traffic flow for the second road has no vehicles, processing logic further initiates a third timer to count a predetermined time duration. If the traffic flow of the first road is determined to remain with at least one vehicle for the predetermined time duration of the third timer, processing logic further displays the default right of way for the traffic signs.

Note that some or all of the components as shown and described above may be implemented in software, hardware, or a combination thereof. For example, such components can be implemented as software installed and stored in a persistent storage device, which can be loaded and executed in a memory by a processor (not shown) to carry out the processes or operations described throughout this application. Alternatively, such components can be implemented as executable code programmed or embedded into dedicated hardware such as an integrated circuit (e.g., an application specific IC or ASIC), a digital signal processor (DSP), or a field programmable gate array (FPGA), which can be accessed via a corresponding driver and/or operating system from an application. Furthermore, such components can be implemented as specific hardware logic in a processor or processor core as part of an instruction set accessible by a software component via one or more specific instructions.

Figure 9:
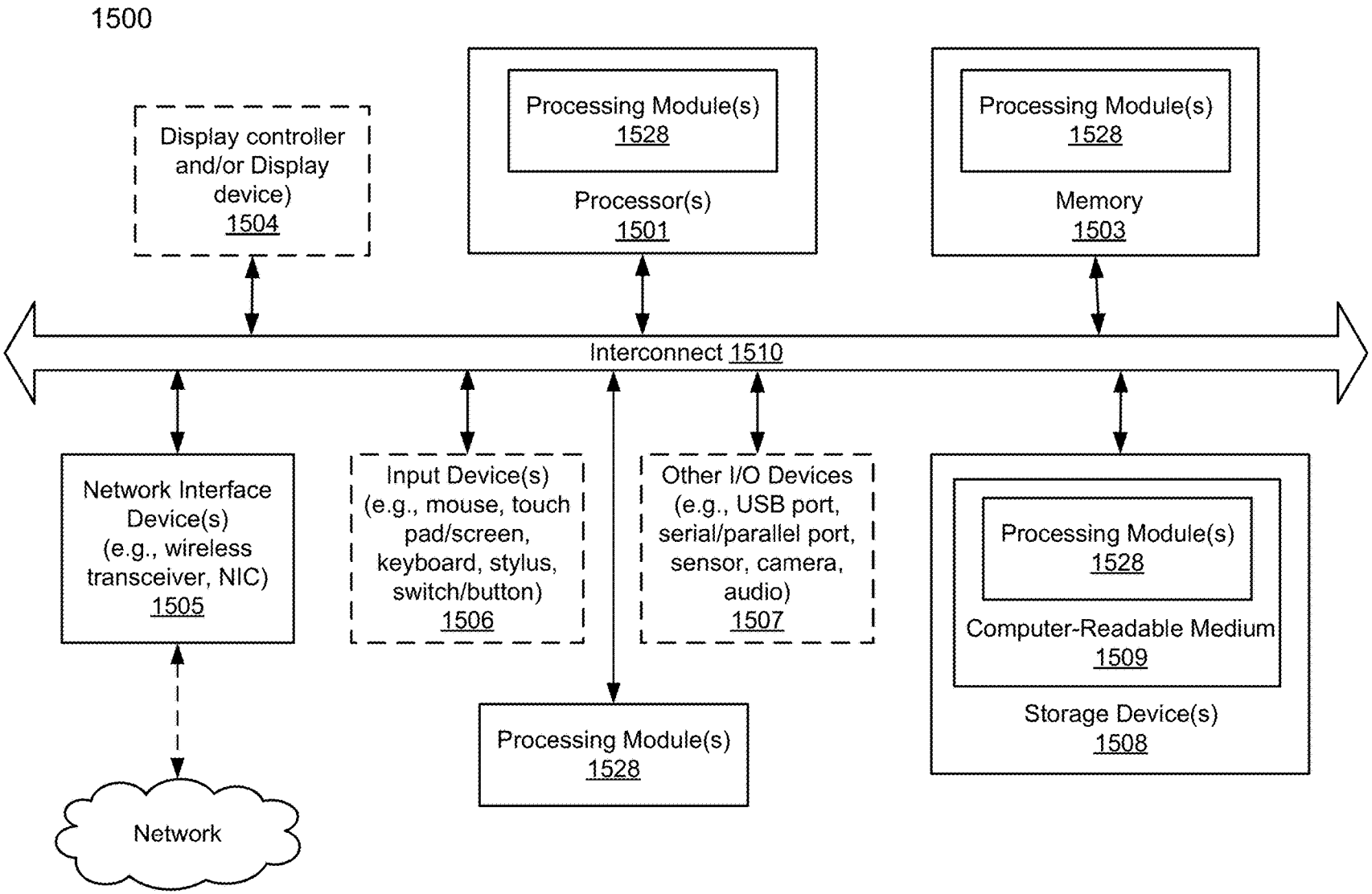
FIG. 9 is a block diagram illustrating a data processing system according to one embodiment.

FIG. 9 is a block diagram illustrating an example of a data processing system which may be used with one embodiment of the disclosure. For example, system 1500 may represent any of data processing systems described above performing any of the processes or methods described above, such as, for example, traffic system 101 or server(s) 103 of FIG. 1. System 1500 can include many different components. These components can be implemented as integrated circuits (ICs), portions thereof, discrete electronic devices, or other modules adapted to a circuit board such as a motherboard or add-in card of the computer system, or as components otherwise incorporated within a chassis of the computer system.

Note also that system 1500 is intended to show a high level view of many components of the computer system. However, it is to be understood that additional components may be present in certain implementations and furthermore, different arrangement of the components shown may occur in other implementations. System 1500 may represent a desktop, a laptop, a tablet, a server, a mobile phone, a media player, a personal digital assistant (PDA), a Smartwatch, a personal communicator, a gaming device, a network router or hub, a wireless access point (AP) or repeater, a set-top box, or a combination thereof. Further, while only a single machine or system is illustrated, the term "machine" or "system" shall also be taken to include any collection of machines or systems that individually or jointly execute a set (or multiple sets) of instructions to perform any one or more of the methodologies discussed herein.

In one embodiment, system 1500 includes processor 1501, memory 1503, and devices 1505-1508 connected via a bus or an interconnect 1510. Processor 1501 may represent a single processor or multiple processors with a single processor core or multiple processor cores included therein. Processor 1501 may represent one or more general-purpose processors such as a microprocessor, a central processing unit (CPU), or the like. More particularly, processor 1501 may be a complex instruction set computing (CISC) microprocessor, reduced instruction set computing (RISC) microprocessor, very long instruction word (VLIW) microprocessor, or processor implementing other instruction sets, or processors implementing a combination of instruction sets. Processor 1501 may also be one or more special-purpose processors such as an application specific integrated circuit (ASIC), a cellular or baseband processor, a field programmable gate array (FPGA), a digital signal processor (DSP), a network processor, a graphics processor, a communications processor, a cryptographic processor, a co-processor, an embedded processor, or any other type of logic capable of processing instructions.

Processor 1501, which may be a low power multi-core processor socket such as an ultra-low voltage processor, may act as a main processing unit and central hub for communication with the various components of the system. Such processor can be implemented as a system on chip (SoC). Processor 1501 is configured to execute instructions for performing the operations and steps discussed herein. System 1500 may further include a graphics interface that communicates with optional graphics subsystem 1504, which may include a display controller, a graphics processor, and/or a display device.

Processor 1501 may communicate with memory 1503, which in one embodiment can be implemented via multiple memory devices to provide for a given amount of system memory. Memory 1503 may include one or more volatile storage (or memory) devices such as random access memory (RAM), dynamic RAM (DRAM), synchronous DRAM (SDRAM), static RAM (SRAM), or other types of storage devices. Memory 1503 may store information including sequences of instructions that are executed by processor 1501, or any other device. For example, executable code and/or data of a variety of operating systems, device drivers, firmware (e.g., input output basic system or BIOS), and/or applications can be loaded in memory 1503 and executed by processor 1501. An operating system can be any kind of operating systems, such as, for example, Robot Operating System (ROS), Windows® operating system from Microsoft®, Mac OS®/iOS® from Apple, Android® from Google®, LINUX, UNIX, or other real-time or embedded operating systems.

System 1500 may further include IO devices such as devices 1505-1508, including network interface device(s) 1505, optional input device(s) 1506, and other optional IO device(s) 1507. Network interface device 1505 may include a wireless transceiver and/or a network interface card (NIC). The wireless transceiver may be a WiFi transceiver, an infrared transceiver, a Bluetooth transceiver, a WiMax transceiver, a wireless cellular telephony transceiver, a satellite transceiver (e.g., a global positioning system (GPS) transceiver), or other radio frequency (RF) transceivers, or a combination thereof. The NIC may be an Ethernet card.

Input device(s) 1506 may include a mouse, a touch pad, a touch sensitive screen (which may be integrated with display device 1504), a pointer device such as a stylus, and/or a keyboard (e.g., physical keyboard or a virtual keyboard displayed as part of a touch sensitive screen). For example, input device 1506 may include a touch screen controller coupled to a touch screen. The touch screen and touch screen controller can, for example, detect contact and movement or break thereof using any of a plurality of touch sensitivity technologies, including but not limited to capacitive, resistive, infrared, and surface acoustic wave technologies, as well as other proximity sensor arrays or other elements for determining one or more points of contact with the touch screen.

IO devices 1507 may include an audio device. An audio device may include a speaker and/or a microphone to facilitate voice-enabled functions, such as voice recognition, voice replication, digital recording, and/or telephony functions. Other IO devices 1507 may further include universal serial bus (USB) port(s), parallel port(s), serial port(s), a printer, a network interface, a bus bridge (e.g., a PCI-PCI bridge), sensor(s) (e.g., a motion sensor such as an accelerometer, gyroscope, a magnetometer, a light sensor, compass, a proximity sensor, etc.), or a combination thereof. Devices 1507 may further include an imaging processing subsystem (e.g., a camera), which may include an optical sensor, such as a charged coupled device (CCD) or a complementary metal-oxide semiconductor (CMOS) optical sensor, utilized to facilitate camera functions, such as recording photographs and video clips. Certain sensors may be coupled to interconnect 1510 via a sensor hub (not shown), while other devices such as a keyboard or thermal sensor may be controlled by an embedded controller (not shown), dependent upon the specific configuration or design of system 1500.

To provide for persistent storage of information such as data, applications, one or more operating systems and so forth, a mass storage (not shown) may also couple to processor 1501. In various embodiments, to enable a thinner and lighter system design as well as to improve system responsiveness, this mass storage may be implemented via a solid state device (SSD). However in other embodiments, the mass storage may primarily be implemented using a hard disk drive (HDD) with a smaller amount of SSD storage to act as a SSD cache to enable non-volatile storage of context state and other such information during power down events so that a fast power up can occur on re-initiation of system activities. Also a flash device may be coupled to processor 1501, e.g., via a serial peripheral interface (SPI). This flash device may provide for non-volatile storage of system software, including BIOS as well as other firmware of the system.

Storage device 1508 may include computer-accessible storage medium 1509 (also known as a machine-readable storage medium or a computer-readable medium) on which is stored one or more sets of instructions or software (e.g., module, unit, and/or logic 1528) embodying any one or more of the methodologies or functions described herein. Processing module/unit/logic 1528 may represent any of the components described above, such as, for example, event determine module 201, timer module 202, state machine module 203, traffic sign display module 204, and condition module 205. Processing module/unit/logic 1528 may also reside, completely or at least partially, within memory 1503 and/or within processor 1501 during execution thereof by data processing system 1500, memory 1503 and processor 1501 also constituting machine-accessible storage media. Processing module/unit/logic 1528 may further be transmitted or received over a network via network interface device 1505.

Computer-readable storage medium 1509 may also be used to store the some software functionalities described above persistently. While computer-readable storage medium 1509 is shown in an exemplary embodiment to be a single medium, the term "computer-readable storage medium" should be taken to include a single medium or multiple media (e.g., a centralized or distributed database, and/or associated caches and servers) that store the one or more sets of instructions. The terms "computer-readable storage medium" shall also be taken to include any medium that is capable of storing or encoding a set of instructions for execution by the machine and that cause the machine to perform any one or more of the methodologies of the present disclosure. The term "computer-readable storage medium" shall accordingly be taken to include, but not be limited to, solid-state memories, and optical and magnetic media, or any other non-transitory machine-readable medium.

Processing module/unit/logic 1528, components and other features described herein can be implemented as discrete hardware components or integrated in the functionality of hardware components such as ASICS, FPGAs, DSPs or similar devices. In addition, processing module/unit/logic 1528 can be implemented as firmware or functional circuitry within hardware devices. Further, processing module/unit/logic 1528 can be implemented in any combination hardware devices and software components.

Note that while system 1500 is illustrated with various components of a data processing system, it is not intended to represent any particular architecture or manner of interconnecting the components; as such details are not germane to embodiments of the present disclosure. It will also be appreciated that network computers, handheld computers, mobile phones, servers, and/or other data processing systems which have fewer components or perhaps more components may also be used with embodiments of the disclosure.

Some portions of the preceding detailed descriptions have been presented in terms of algorithms and symbolic representations of operations on data bits within a computer memory. These algorithmic descriptions and representations are the ways used by those skilled in the data processing arts to most effectively convey the substance of their work to others skilled in the art. An algorithm is here, and generally, conceived to be a self-consistent sequence of operations leading to a desired result. The operations are those requiring physical manipulations of physical quantities.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as those set forth in the claims below, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

Embodiments of the disclosure also relate to an apparatus for performing the operations herein. Such a computer program is stored in a non-transitory computer readable medium. A machine-readable medium includes any mechanism for storing information in a form readable by a machine (e.g., a computer). For example, a machine-readable (e.g., computer-readable) medium includes a machine (e.g., a computer) readable storage medium (e.g., read only memory ("ROM"), random access memory ("RAM"), magnetic disk storage media, optical storage media, flash memory devices).

The processes or methods depicted in the preceding figures may be performed by processing logic that comprises hardware (e.g. circuitry, dedicated logic, etc.), software (e.g., embodied on a non-transitory computer readable medium), or a combination of both. Although the processes or methods are described above in terms of some sequential operations, it should be appreciated that some of the operations described may be performed in a different order. Moreover, some operations may be performed in parallel rather than sequentially.

Embodiments of the present disclosure are not described with reference to any particular programming language. It will be appreciated that a variety of programming languages may be used to implement the teachings of embodiments of the disclosure as described herein.

In the foregoing specification, embodiments of the disclosure have been described with reference to specific exemplary embodiments thereof. It will be evident that various modifications may be made thereto without departing from the broader spirit and scope of the disclosure as set forth in the following claims. The specification and drawings are, accordingly, to be regarded in an illustrative sense rather than a restrictive sense.

What is claimed is:

1. A computer-implemented method to determine a right of way of traffic, the method comprising:

displaying a priority sign on a first traffic sign for a first road and displaying a yield sign on a second traffic sign for a second road as a default right of way for a road intersection intersecting the first road and the second road;

receiving signals from one or more X2X sensors detecting a first traffic flow for the first road and a second traffic flow for the second road before the road intersection;

initiating a first timer to count a predetermined time duration, in response to determining based on the signals that the first traffic flow has no vehicle and the second traffic flow includes at least one vehicle; and displaying a yield sign on the first traffic sign and displaying a priority sign on the second traffic sign to reverse the default right of way for the intersection, if the first traffic flow of the first road remains with no vehicle when the first timer expires.

2. The method of claim 1, wherein the first and second traffic signs are binary traffic signs such that if the first traffic sign is to display a yield sign, the second traffic sign is automatically updated to display a priority sign, or vice versa.

3. The method of claim 1, wherein the first and second traffic signs for the first and the second roads are displayed using electronic digital traffic signs.

4. The method of claim 1, further comprising determining a state for the first and second traffic signs using a state machine, wherein the state machine includes at least three states: an initial state, a default state, and a reverse state.

5. The method of claim 1, further comprising:

if the first and second traffic flows are determined to have no vehicles, initiating a second timer to count a second predetermined time duration; and if the first and second traffic flows of both the first and the second roads are determined to remain with no vehicle when the second timer expires, configuring the first and second traffic signs to represent the default right of way of the road intersection.

6. The method of claim 1, further comprising:

if the first and second traffic flows are each determined to include at least one vehicle and the first and second traffic signs are configured to represent the default right of way, maintaining the first and second traffic signs as the default right of way, or if the first and second traffic flows are each determined to include at least one vehicle and the first and second traffic signs include a reversed right of way, maintaining the first and second traffic signs as a reversed right of way.

7. The method of claim 1, further comprising:

if the first traffic flow for the first road includes at least one vehicle and the second traffic flow for the second road has no vehicles, initiating a third timer to count a third predetermined time duration; and if the first traffic flow of the first road remains with at least one vehicle when the third timer expires, changing the first and second traffic signs to represent the default right of way.

8. A non-transitory machine-readable medium having instructions stored therein, which when executed by a processor, cause the processor to perform operations, the operations comprising:

displaying a priority sign on a first traffic sign for a first road and displaying a yield sign on a second traffic sign for a second road as a default right of way for a road intersection intersecting the first road and the second road;

receiving signals from one or more X2X sensors detecting a first traffic flow for the first road and a second traffic flow for the second road before the road intersection;

initiating a first timer to count a predetermined time duration, in response to determining based on the signals that the first traffic flow has no vehicle and the second traffic flow includes at least one vehicle; and displaying a yield sign on the first traffic sign and displaying a priority sign on the second traffic sign to reverse the default right of way for the intersection, if the first traffic flow of the first road remains with no vehicle when the first timer expires.

9. The machine-readable medium of claim 8, wherein the first and second traffic signs are binary traffic signs such that if the first traffic sign is to display a yield sign, the second traffic sign is automatically updated to display a priority sign, or vice versa.

10. The machine-readable medium of claim 8, wherein the first and second traffic signs for the first and the second roads are displayed using electronic digital traffic signs.

11. The machine-readable medium of claim 8, wherein the operations further comprise determining a state for the first and second traffic signs using a state machine, wherein the state machine includes at least three states: an initial state, a default state, and a reverse state.

12. The machine-readable medium of claim 8, wherein the operations further comprise:

if the first and second traffic flows are determined to have no vehicles, initiating a second timer to count a second predetermined time duration; and if the first and second traffic flows of both the first and the second roads are determined to remain with no vehicle when the second timer expires, configuring the first and second traffic signs to represent the default right of way of the road intersection.

13. The machine-readable medium of claim 8, wherein the operations further comprise:

if the first and second traffic flows are each determined to include at least one vehicle and the first and second traffic signs are configured to represent the default right of way, maintaining the first and second traffic signs as the default right of way, or if the first and second traffic flows are each determined to include at least one vehicle and the first and second traffic signs include a reversed right of way, maintaining the first and second traffic signs as a reversed right of way.

14. The machine-readable medium of claim 8, wherein the operations further comprise:

if the first traffic flow for the first road includes at least one vehicle and the second traffic flow for the second road has no vehicles, initiating a third timer to count a third predetermined time duration; and if the first traffic flow of the first road remains with at least one vehicle when the third timer expires, changing the first and second traffic signs to represent the default right of way.

15. A data processing system, comprising:

a processor; and a memory coupled to the processor to store instructions, which when executed by the processor, cause the processor to perform operations, the operations including displaying a priority sign on a first traffic sign for a first road and displaying a yield sign on a second traffic sign for a second road as a default right of way for a road intersection intersecting the first road and the second road, receiving signals from one or more X2X sensors detecting a first traffic flow for the first road and a second traffic flow for the second road before the road intersection, initiating a first timer to count a predetermined time duration, in response to determining based on the signals that the first traffic flow has no vehicle and the second traffic flow includes at least one vehicle, and displaying a yield sign on the first traffic sign and displaying a priority sign on the second traffic sign to reverse the default right of way for the intersection, if the first traffic flow of the first road remains with no vehicle when the first timer expires.

16. The system of claim 15, wherein the first and second traffic signs are binary traffic signs such that if the first traffic sign is to display a yield sign, the second traffic sign is automatically updated to display a priority sign, or vice versa.

17. The system of claim 15, wherein the first and second traffic signs for the first and the second roads are displayed using electronic digital traffic signs.

18. The system of claim 15, wherein the operations further comprise determining a state for the first and second traffic signs using a state machine, wherein the state machine includes at least three states: an initial state, a default state, and a reverse state.

19. The system of claim 15, wherein the operations further comprise:

if the first and second traffic flows are determined to have no vehicles, initiating a second timer to count a second predetermined time duration; and if the first and second traffic flows of both the first and the second roads are determined to remain with no vehicle when the second timer expires, configuring the first and second traffic signs to represent the default right of way of the road intersection.

20. The system of claim 15, wherein the operations further comprise:

if the first and second traffic flows are each determined to include at least one vehicle and the first and second traffic signs are configured to represent the default right of way, maintaining the first and second traffic signs as the default right of way, or if the first and second traffic flows are each determined to include at least one vehicle and the first and second traffic signs include a reversed right of way, maintaining the first and second traffic signs as a reversed right of way.

21. The system of claim 15, wherein the operations further comprise:

if the first traffic flow for the first road includes at least one vehicle and the second traffic flow for the second road has no vehicles, initiating a third timer to count a third predetermined time duration; and if the first traffic flow of the first road remains with at least one vehicle when the third timer expires, changing the first and second traffic signs to represent the default right of way.

* * * * *